United States Patent [19]

Kanehira

[11] 4,440,585

[45] Apr. 3, 1984

[54] AMORPHOUS MAGNETIC ALLOY

[75] Inventor: Jun Kanehira, Hachioji, Japan

[73] Assignee: Olympus Optical Co., Ltd., Tokyo, Japan

[21] Appl. No.: 455,523

[22] Filed: Jan. 4, 1983

[30] Foreign Application Priority Data

Jan. 19, 1982 [JP] Japan ..... 57-6571
Mar. 12, 1982 [JP] Japan ..... 57-38999

[51] Int. Cl.[3] ..... C22C 19/07

[52] U.S. Cl. ..... 148/403; 148/31.55; 420/435

[58] Field of Search ..... 148/31.55, 403; 420/435

[56] References Cited

U.S. PATENT DOCUMENTS 4,116,682 9/1978 Polk et al. ..... 148/403
4,144,058 3/1979 Chen et al. ..... 148/403
4,255,189 3/1981 Ray ..... 148/403

FOREIGN PATENT DOCUMENTS 56-69360 6/1981 Japan ..... 148/31.55
56-130449 10/1981 Japan ..... 148/403

OTHER PUBLICATIONS

Graham et al., "Magnetic Properties of Amorphous Materials", *Metals Technology*, Jun. 1980, pp. 244–247.

*Primary Examiner*—John P. Sheehan
*Attorney, Agent, or Firm*—Frishauf, Holtz, Goodman & Woodward

[57] ABSTRACT

An amorphous magnetic alloy having the formula $Co_x$-$M_yB_z$ wherein M is zirconium, hafnium and/or titanium. When M is hafnium or zirconium $70 \leqq x \leqq 80$, $8 \leqq y \leqq 15$ and $10 \leqq z \leqq 16$. When M is titanium, $70 \leqq x \leqq 72$, $16 \leqq y \leqq 25$ and $4 \leqq z \leqq 10$. When M is hafnium together with titanium and/or zirconium, $70 \leqq x \leqq 80$, $8 \leqq y \leqq 20$ and $5 \leqq z \leqq 16$.

6 Claims, 6 Drawing Figures

AMORPHOUS MAGNETIC ALLOY

BACKGROUND OF THE INVENTION

This invention relates to an amorphous magnetic alloy adapted to, for example, a magnetic core of a magnetic head. To date, Permalloy, ferrite or Sendust has been used as the crystalline core of a magnetic head. However, Permalloy has the drawbacks that though it possesses good soft-magnetic properties and machinability, it has a relatively low saturation magnetic flux density, low electric resistance, and consequently a low A.C. magnetic permeability, and a low abrasion resistance due to its softness. The ferrite also has the drawback that though it possesses an excellent high frequency property due to its high electric resistance and also a great abrasion resistance due to its hardness, yet it has a low saturation magnetic flux density, which presents difficulties in machining due to its hardness and brittleness, and gives rise to problems with respect to corrosion resistance because it mainly consists of iron.

Recently, attention has been drawn to a pure amorphous magnetic material, in place of a crystalline magnetic material. The amorphous magnetic material has been actively used in various applications. The amorphous magnetic material has the following characteristics.

(a) The amorphous magnetic material has no crystalline anisotropy, and, when its composition is free from magnetostrictions, it indicates as high a magnetic permeability $\mu$ as Permalloy.

(b) When alloyed with, for example, chromium or molybdenum, the amorphous magnetic material has higher corrosion resistance than stainless steel.

(c) The amorphous magnetic material has great hardness and indicates as high an abrasion resistance as Sendust.

(d) The amorphous magnetic material has high electric resistance and is generally produced with as small a thickness as about 40 microns, and consequently indicates high magnetic permeability $\mu$ in the high frequency region.

(e) The amorphous magnetic material indicates relatively high saturation magnetic flux density of about 7 to 9 kilogausses.

Patent disclosure No. 51-73920 may be cited as a published information describing an amorphous alloy of high magnetic permeability. The disclosed amorphous magnetic material has a typical composition of $Fe_5Co_{70}Si_{15}B_{10}$. The amorphous magnetic material has a more metastable state than a crystalline magnetic material. The amorphous magnetic material is generally crystallized at a temperature (hereinafter referred to as "a crystallization temperature Tx") of 400° to 500° C., and loses its soft magnetic property. Consequently, the amorphous magnetic material is desired to have as high a crystallization temperature Tx as possible. The disclosed amorphous magnetic material having a composition of $Fe_5Co_{70}Si_{15}B_{10}$ has a relatively high crystallization temperature Tx of about 500° C. However, an amorphous magnetic material is demanded to have a higher crystallization temperature Tx in order to have a higher thermal stability. Said amorphous magnetic material whose composition is represented, for example, by $Fe_5Co_{70}Si_{15}B_{10}$ lacks a corrosion resistance-improving element such as chromium or molybdenum and does not indicate a high corrosion resistance.

SUMMARY OF THE INVENTION

This invention has been accomplished in view of the above-mentioned circumstances and is intended to provide an amorphous magnetic alloy adapted to be used as a core of a magnetic head. Another object is particularly to provide an amorphous soft magnetic alloy having substantially higher thermal stability and corrosion resistance than the conventional amorphous magnetic alloy.

DETAILED DESCRIPTION OF THE PREFERRED EMBODIMENT

An amorphous magnetic material embodying this invention is chosen to have any of the undermentioned compositions.

(1) Now let it be assumed that M represents either or both of Zr and Hf, and x, y, and z are used as suffixes denoting atomic percent. Then in an amorphous magnetic alloy expressed as $Co_xM_yB_z$, said x, y and z are respectively chosen to indicate composition percentages as $70 \leqq x \leqq 80$, $8 \leqq y \leqq 15$ and $8 \leqq z \leqq 16$. In the above description, Zr, Hf, Co and B respectively denote zirconium, hafnium, cobalt and boron.

(2) In the composition $Co_xTi_yB_z$ of an amorphous magnetic alloy, said x, y and z are respectively chosen to denote composition percentages as $70 \leqq x \leqq 80$, $16 \leqq y \leqq 25$ and $4 \leqq z \leqq 10$. Ti denotes titanium, and $x+y+z$ is taken to represent 100%.

(3) Now let it be assumed that M denotes a combination of any two or all of Ti, Zr and Hf. In the composition $Co_xM_yB_z$ of an amorphous magnetic alloy, said x, y and z are respectively chosen to represent composition percentages as $70 \leqq x \leqq 80$, $8 \leqq y \leqq 20$ and $5 \leqq z \leqq 16$, and $x+y+z$ is taken to denote 100%.

An amorphous magnetic alloy expressed as $Co_xM_yB_z$ described in the above item (1) indicates a preferred property (higher permeability $\mu$ and lower coercive force Hc), if its composition falls within the range of $73 \leqq x \leqq 77$, $11 \leqq y \leqq 14$ and $11 \leqq z \leqq 14$.

With respect to the above item (3), it is possible to apply any of the undermentioned combinations of (i) to (iv).

$$Co_x(Ti_{y1}Zr_{y2})B_z = Co_xM_yB_z \quad \text{(i)}$$

$$Co_x(Zr_{y3}Hf_{y4})B_z = Co_xM_yB_z \quad \text{(ii)}$$

$$Co_x(Hf_{y5}Ti_{y6})B_z = Co_xM_yB_z \quad \text{(iii)}$$

$$Co_x(Ti_{y7}Zr_{y8}Hf_{y9})B_z = Co_xM_yB_z \quad \text{(iv)}$$

It will be noted that so long as the condition $8 \leqq y \leqq 20$ is satisfied, subscripts y1 to y9 indicating the atomic % of Ti, Zr and Hf denote any optional value. In the case of, for example, the above combination (i), the ratio of y1 to y2 can be freely determined, provided the condition $8 \leqq y1 + y2 \leqq 20$ is satisfied.

Description will now be given to the reason why the limitations referred to in the aforementioned items (1) to (3) are imposed on an amorphous magnetic alloy of the present invention.

Figure 1:
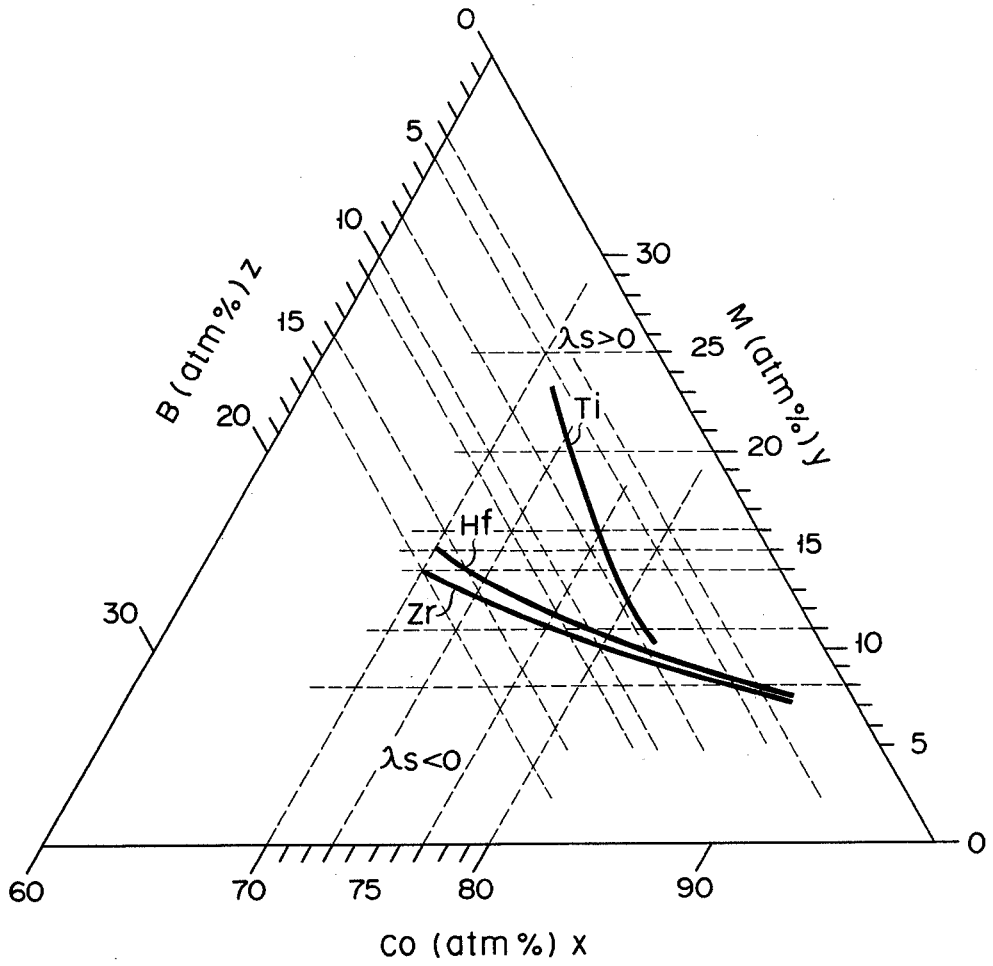
FIG. 1 graphically shows the compositions of amorphous magnetic alloys embodying this invention which is free from magnetostrictions with respect to M=Ti, M=Hf and M=Zr.
Figure 2:
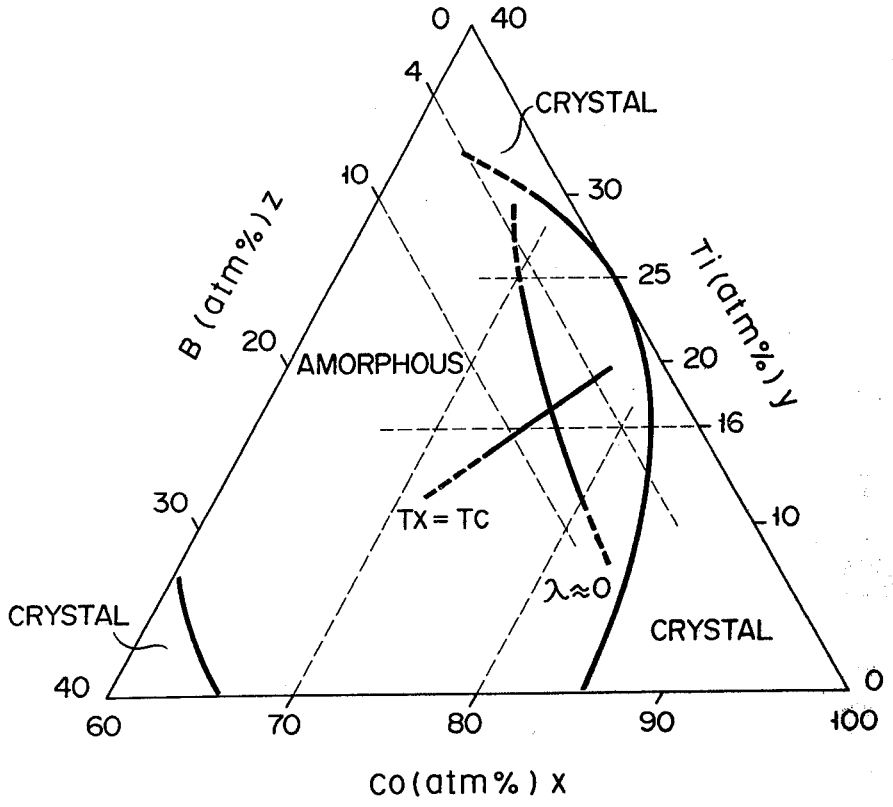
FIG. 2 indicates the range in which a magnetic alloy of Co-Ti-B embodying this invention can be rendered amorphous, wherein the dependency of magnetostriction $\lambda=0$ on the composition of the subject amorphous magnetic alloy and the dependency on said composition of the condition in which the crystallization temperature Tx is equal to the Curie temperature Tc, is graphically shown.
Figure 3:
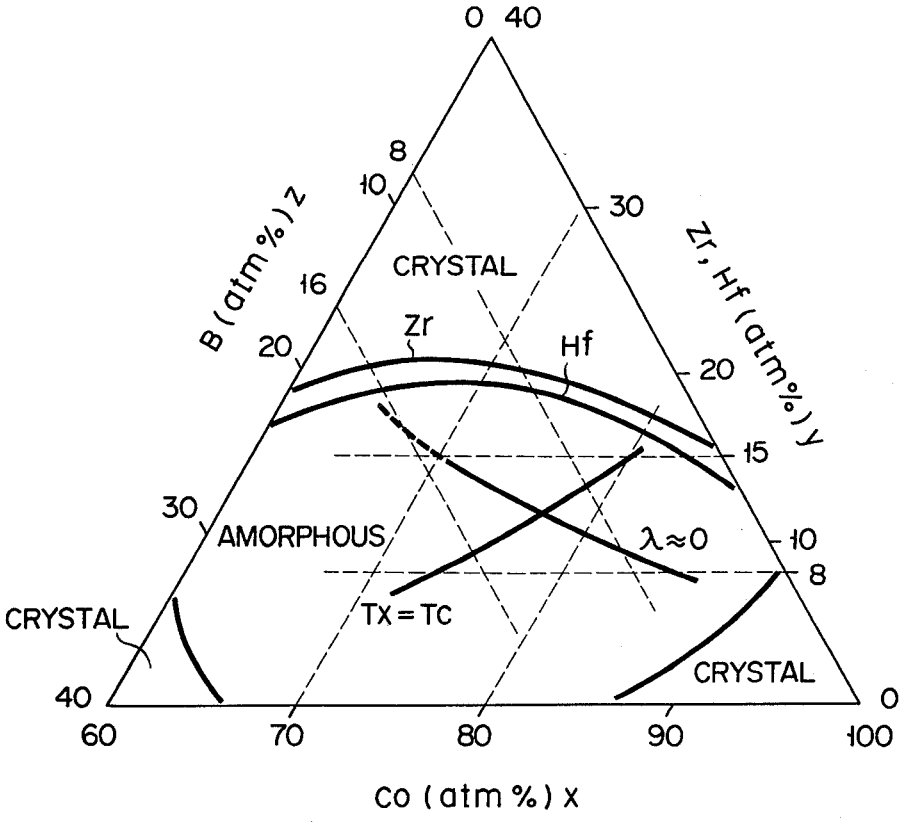
FIG. 3 indicates the range in which a magnetic alloy of Co-(Zr, Hf)-B embodying this invention can be rendered amorphous, wherein the dependency of magnetostriction $\lambda=0$ on the composition of the subject amorphous magnetic alloy and the dependency on said composition of the condition in which the crystallization temperature Tx is equal to the Curie temperature Tc, is graphically shown.

FIG. 1 illustrates the composition of an amorphous magnetic alloy embodying this invention. FIG. 1 indicates a composition in which a magnetostriction $\lambda$ is taken to be zero, in case of M=Ti, M=Hf and M=Zr. Where the scale of graph of FIG. 1 is equidistantly interpolated with respect to the cases of M=Ti, M=Hf and M=Zr, then it is possible to determine the composition of Co, M and B (atomic %) providing $\lambda=0$. In FIG. 1, $\lambda_s$ denotes a saturated value of a magnetostriction $\lambda$ when a magnetic field H is progressively enhanced. A soft magnetic material having composition that is free from any magnetostriction generally indicates high magnetic permeability. A magnetic alloy embodying this invention which is no exception to this rule is chosen to have a composition in which substantially no magnetostriction arises. The reason why Co is chosen to have a smaller atomic percent than 80 is that as shown in FIG. 2 or 3, the magnitude relation between crystallization temperature Tx and Curie temperature Tc is inverted (e.g. $Tx > Tc \rightarrow Tx < Tc$) in a region where Co has a roughly 80 atomic percent; and when Co has a larger atomic percent, it is impossible to improve the soft magnetic property of a magnetic alloy by heat treatment. The reason why Co included in the magnetic alloy of this invention is chosen to have a larger atomic percent than 70 is that when Co has a smaller atomic percent, the resultant magnetic alloy decreases in saturation magnetic flux density. The reason why B included in the magnetic alloy of the invention is chosen to have a smaller atomic percent than 16 is that a large content of B causes an amorphous magnetic alloy to be brittle.

Known amorphous soft magnetic materials are prepared from ferromagnetic transition metals such as Fe, Co and Ni alloyed with metalloids such as Si, B, P and C. Japanese patent disclosure No. 51-73920 sets forth a typical amorphous soft magnetic material. The amorphous magnetic alloy disclosed indicates an excellent soft magnetic property and a high ability to be rendered amorphous. The amorphous magnetic alloy may be widely accepted for use with various magnetic devices including a magnetic head. It is recently reported that alloys of ferromagnetic transition metals such as Fe, Co and Ni and transition metals of Group IV such as Ti, Zr and Hf can be rendered amorphous and ferromagnetic, when the alloys have prescribed compositions. However, these alloys can not be expected to indicate high magnetic permeability, because said alloys possess a positive magnetostriction $\lambda$. Therefore, an amorphous magnetic alloy free from a magnetostriction $\lambda$ is proposed which is prepared by adding a transition metal such as Cr, Mo, W or V as a third element to the above-mentioned magnetic alloy. This proposed amorphous metal-metal alloy (for example, an alloy of Co group) has a high crystallization temperature Tx, is thermally stable, and has such hardness as corresponds to about two-thirds that of a metal-metalloid alloy. Consequently the proposed amorphous metal-metal alloy has high machinability and abrasion resistance. Nevertheless, the proposed amorphous metal-metal alloy has a lower grade as to a soft magnetic property than a metal-metalloid alloy and more over has a low saturation magnetic flux density Bs. The saturation magnetic flux density Bs of the proposed amorphous metal-metal alloy having a composition of $Tx \approx Tc$ is limited to about 8 kilogausses. Further, a detrimental defect of the proposed magnetic alloy is that it has an extremely low property of being rendered amorphous.

The present inventor has tried to improve the property of an amorphous magnetic alloy consisting of Co-(Ti, Zr, Hf) in view of the aforementioned circumstances. As a result, it has been discovered that when a metalloid B is substituted for part of the amorphous alloy system of Co-(Ti, Zr, Hf), then a region being free from a magnetostriction appears in the region which can be rendered amorphous, and heat treatment at a temperature T expressed as $Tx > T > Tc$ produces an alloy having an excellent soft magnetic property. An alloy system of Co-(Ti, Zr, Hf)-B obtained by addition of said metalloid B has a noticeably increased property of being rendered amorphous as seen from FIG. 2, thereby improving the low property of the aforementioned metal-metal alloy of being rendered amorphous.

Figure 4:
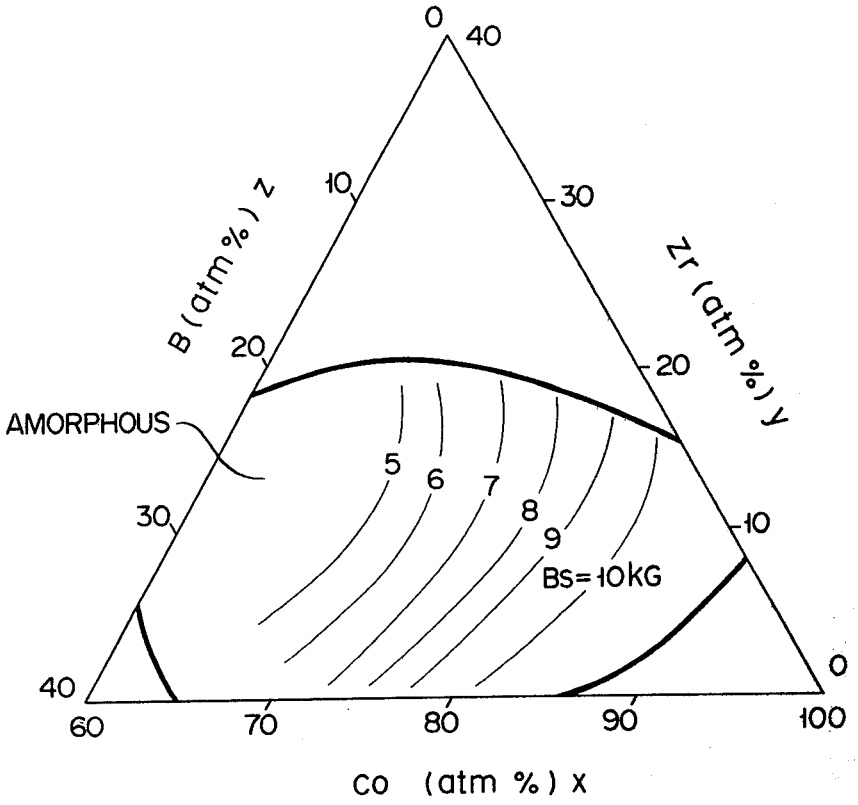
FIG. 4 shows how the saturation magnetic flux density Bs of Co-Zr-B amorphous alloy depends on its composition.

FIG. 4 graphically illustrates how the saturation magnetic flux density Bs of Co-Zr-B amorphous alloy depends on its composition. According to an alloy of this invention, the thickness of the sample do not affect the density Bs.

Figure 5:
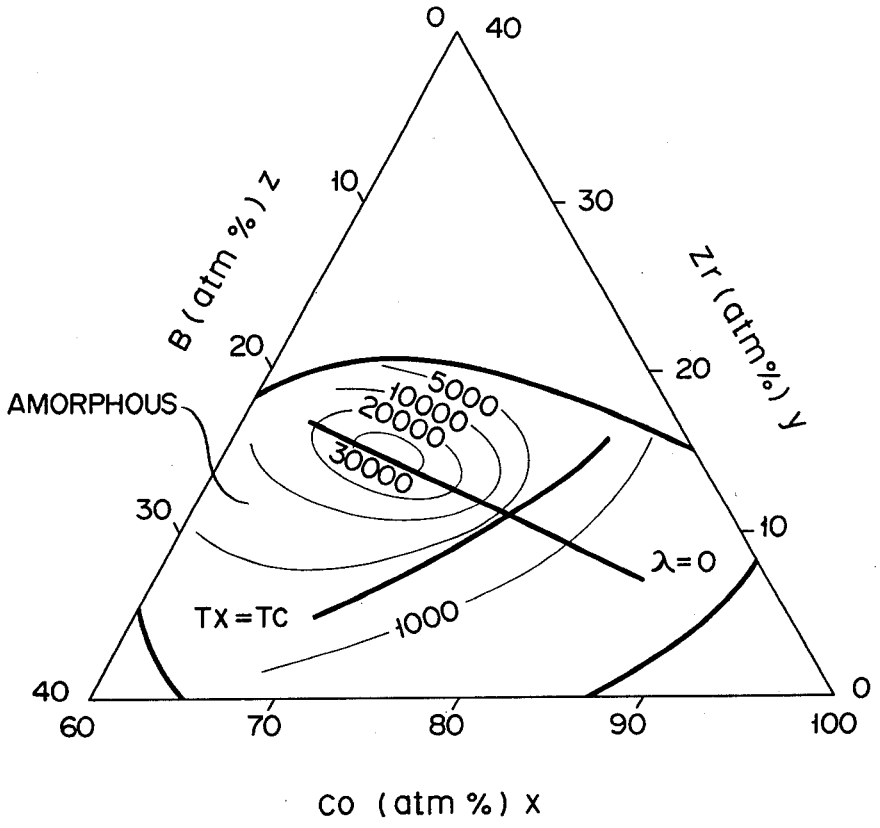
FIG. 5 shows how the permeability of Co-Zr-B amorphous alloy depends on its composition.

FIG. 5 graphically illustrates how the permeability $\mu_e$ of Co-Zr-B amorphous alloy depends on its composition. The permeability $\mu_e$ depends on the thickness of the alloy. The illustrated data (20 $\mu$m thickness) is almost best one.

Figure 6:
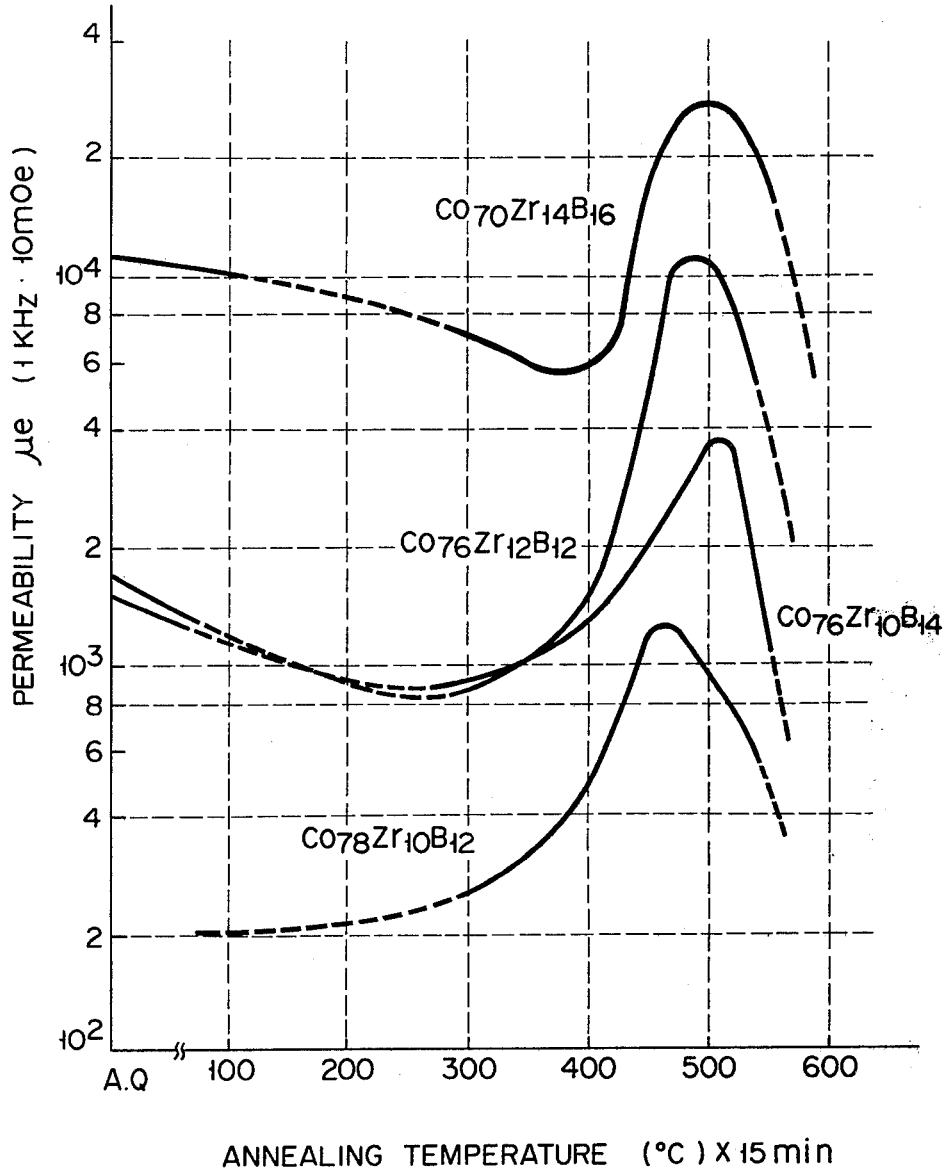
FIG. 6 shows how the permeability of Co-Zr-B amorphous alloy depends on a condition of annealing.

FIG. 6 shows how the permeability $\mu_e$ of Co-Zr-B amorphous alloy depends on a condition of annealing. The heating time at each annealing temperature is 15 minutes.

EXAMPLES

This invention will be more apparent from the following experiments which have been conducted until the invention was accomplished.

Samples were prepared with a width of about 2 mm and a thickness of about 20 microns by applying liquid quenching. The samples were determined by X-ray analysis to be amorphous. The magnetic flux density Bs of the samples were determined on a magnetic balance by measurement of the density of said samples. The coercive force Hc was determined by a self-registering magnetic flux meter. The magnetic permeability $\mu_e$ was determined by the Maxwell bridge at 1 kHz, 10 mOe. The crystallization temperature was determined by the differential thermal analyzer. The Curie temperature Tc was measured from changes in temperature in the magnetic permeability $\mu_e$.

An amorphous magnetic alloy embodying this invention has a high crystallization temperature Tx of about 500° C. to about 600° C. as shown in Table 1 below, and is prominently thermally stable. Table 1 also indicates the soft magnetic property and Curie temperature Tc of various amorphous magnetic alloys embodying this invention. Table 2 below shows changes in the weight of the amorphous magnetic alloys when dipped in a solution containing 0.2 N HCl for 200 hours, that is, their corrosion resistance. Table 2 proves that even when the various magnetic alloys embodying this invention are dipped in the solution of 0.2 N HCl for 200 hours, the elements Zr, Hf included in the magnetic alloys undergo substantially no physical change, namely, indicating that said magnetic alloys have an extremely high corrosion resistance.

As described above, this invention provides an amorphous magnetic alloy which is thermally stable, highly corrosion-resistant and has an excellent soft magnetic property.

TABLE 2

| Alloy composition | 0 (hr) | 100 (hr) | 200 (hr) |
|---|---|---|---|
| $Co_{70}Ti_8B_{22}$ | 1.00 | 0.72 | 0.69 |
| $Co_{70}Zr_8B_{22}$ | 1.00 | 0.93 | 0.90 |
| $Co_{70}Hf_8B_{22}$ | 1.00 | 0.97 | 0.96 |

What is claimed is:

1. An amorphous magnetic alloy having the composition $Co_xM_yB_z$, M is at least one element selected from the group consisting of zirconium and hafnium, and x, y, z are respective atomic percents and $70 \leqq x \leqq 80$, $8 \leqq y \leqq 15$ and $10 \leqq z \leqq 16$.

2. The amorphous magnetic alloy of claim 1, wherein $73 \leqq x \leqq 77$, $11 \leqq y \leqq 14$ and $11 \leqq z \leqq 14$.

3. The amorphous magnetic alloy of claim 1, wherein M is zirconium and said alloy had been annealed at a temperature between about 400° C. and about 600° C.

4. The amorphous magnetic alloy of claim 3, wherein said alloy had been annealed at this temperature for about 15 minutes.

5. An amorphous magnetic alloy having the composition $Co_xTi_yB_z$, x, y and z are respective atomic percent, and $70 \leqq x < 72$, $18 \leqq y \leqq 25$ and $5 \leqq z \leqq 10$.

6. An amorphous magnetic alloy having the composition $Co_xM_yB_z$, M is hafnium and at least one element selected from the group consisting of titanium and zirconium, and x, y, z are respective atomic percents, and $70 \leqq x \leqq 80$, $8 \leqq y \leqq 20$ and $5 \leqq z \leqq 16$.

* * * * *

TABLE 1

| Alloy composition | Bs (kG) | Before heat treatment $\mu_e$ (1kHz, 10mOe) | After heat treatment $\mu_e$ (1kHz, 10mOe) | After heat treatment $Hc_{(mOe)}$ | Tx (°C.) | Tc (°C.) | $\lambda_s$ |
|---|---|---|---|---|---|---|---|
| $Co_{76}Ti_{18}B_6$ | 6.5 | 13,000 | 13,000 | 18 | 485 | 400 | 0 |
| $Co_{72}Ti_{22}B_6$ | 5.8 | 4,000 | 10,900 | 16.5 | 555 | 350 | 0 |
| $Co_{76}Zr_{12}B_{12}$ | 7.1 | 4,800 | 11,000 | — | 605 | 450 | 0 |
| $Co_{74}Zr_{12}B_{14}$ | 6.9 | 4,500 | 9,300 | 33 | 616 | 400 | 0 |
| $Co_{70}Zr_{14}B_{16}$ | 5.0 | 11,200 | 28,000 | 15 | 605 | 400 | 0 |
| $Co_{76}Hf_{12}B_{12}$ | 5.8 | 3,500 | 12,400 | — | 600 | 450 | 0 |
| $Co_{74}Hf_{12}B_{14}$ | 5.5 | 1,600 | 6,400 | — | 519 | 400 | 0 |
| $Co_{74}Hf_{14}B_{12}$ | 5.1 | 1,600 | 7,200 | 66 | 567 | 348 | 0 |